US005642748A

United States Patent [19]

Obitts

[11] Patent Number: 5,642,748

[45] Date of Patent: Jul. 1, 1997

[54] WALKER TRAY

[75] Inventor: Shane Obitts, Elyria, Ohio

[73] Assignee: Invacare Corporation, Elyria, Ohio

[21] Appl. No.: 559,182

[22] Filed: Nov. 13, 1995

[51] Int. Cl.[6] ..... A45B 3/00

[52] U.S. Cl. ..... 135/66; 135/67; 297/6

[58] Field of Search ..... 135/66, 67, 65; 297/5–7; 482/66, 68; 280/87.021

[56] References Cited

U.S. PATENT DOCUMENTS

| | | | |
|---|---|---|---|
| 3,658,079 | 4/1972 | Block | 135/67 |
| 3,688,789 | 9/1972 | Bunch | 135/67 |
| 3,690,652 | 9/1972 | Schneider | 135/67 X |
| 3,945,389 | 3/1976 | Smith | 135/67 |
| 4,826,240 | 5/1989 | Karpiuk | 135/67 X |
| 4,907,839 | 3/1990 | Rose et al. | 135/67 X |
| 5,273,063 | 12/1993 | Farr et al. | 135/66 |
| 5,353,824 | 10/1994 | Woods et al. | 135/66 |

*Primary Examiner*—Lanna Mai

*Attorney, Agent, or Firm*—Fay, Sharpe, Beall, Fagan, Minnich & McKee

[57] ABSTRACT

A pivoting tray is provided for a walker. A pair of link arms disposed on each side of the tray provide for ease of movement between a first, operative position disposed between side frame assemblies of the walker, to a second, storage position generally vertically oriented in front of the walker. The mounting brackets are adapted for use with either a single actuator or dual release style of walker. Moreover, the mounting bracket is symmetrical for use on both the right-hand and left-hand sides of the walker, thereby reducing manufacturing costs and inventory.

10 Claims, 2 Drawing Sheets

WALKER TRAY

BACKGROUND OF THE INVENTION

This invention pertains to the art of patient aid devices such as walkers. The present invention is particularly directed to a tray mounted to different types of walkers where the tray can be selectively positioned in operative and storage positions. In the storage position, the tray will not adversely interfere with the ability of a person who is physically challenged to use the walker.

Trays for walkers are generally known in the art, for example, U.S. Pat. Nos. 5,217,032 and 5,273,063. The '032 patent discloses a tray in which a pair of clamps are provided on opposite sides of the tray and adapted for sliding movement relative to side cross-brace members. In this manner, the tray can be positioned entirely between side frame members of the walker or pushed outwardly toward the front frame. This latter, storage position, though, only partially opens the region between the side frames to accommodate the user. The '063 patent, on the other hand, provides a tray that pivots between a storage position (FIG. 3) and an operative position (FIG. 1). Two types of mechanisms (FIGS. 4 and 7) are shown and described therein to provide pivotal movement of the tray.

Unfortunately, these prior art devices have various drawbacks. For example, the tray of the '032 patent partially intrudes on the space between the side frame members when pushed fully forward to its storage position. Even though the '063 patent does not suffer from that drawback, it requires a number of specially formed support braces to allow the pivoting action of the tray. Stated another way, separate inventories are required for right-hand and left-hand components of the tray support assembly, which components are not readily interchangeable.

Moreover, many manufacturers market various styles of walkers. For instance, the assignee of the present application provides a walker that has a single release mechanism for folding the walker for storage purposes. Also offered is a substantially similar walker that has dual release actuators, one for each leg, whereby each leg can be separately folded inwardly toward a pivot brace. The above-described tray structures of the prior art would not be universal or compatible with these different versions of the walker. Accordingly, there is a need to develop an alternative tray construction for a walker that is adaptable to different walker types or styles and easily moves between operative and storage positions.

SUMMARY OF THE INVENTION

The present invention contemplates a new and improved tray assembly for a walker that overcomes the above-referenced problems and others, and provides a versatile structure that minimizes the number of parts and reduces inventory.

In accordance with the present invention, there is provided a walker having a tray that is selectively positioned between storage and operative positions. The tray includes a pivoting linkage assembly defined by a pair of links on each side of the tray.

According to a more limited aspect of the invention, first link arms rotate through approximately 180° from the storage position to the operative position of the tray while the second link arms rotate through approximately 90°.

According to another aspect of the invention, the support brackets have multiple link arm pivot points to provide adjustability for different styles or types of walkers.

According to a still further aspect of the invention, the right-hand and left-hand support brackets are preferably identical in construction.

A principal advantage of the invention is the ability to accommodate different styles of walkers with a tray.

Another advantage of the invention is a tray that is easily located in position for use and conveniently stored without interfering with operation or use of the walker.

Yet another advantage is the use of a minimum number of parts to simplify manufacturing and reduce inventory.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
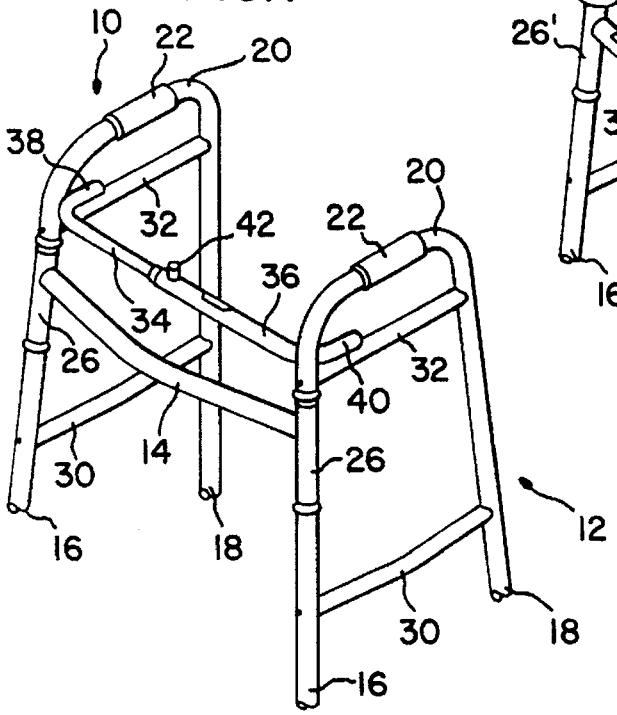
FIG. 1 is a perspective view of a first style of walker having a common or single release mechanism.

Referring now to the drawings wherein the showings are for the purposes of illustrating the preferred embodiment of the invention only and not for purposes of limiting same, the Figures show a walker A (FIG. 1) or A' (FIG. 2) of conventional arrangement. As will be appreciated, the walkers A, A' are substantially identical so that primed suffixes will refer to like elements and new numerals will be used to refer to new elements.

The walker A includes first and second side frame assemblies 10, 12 interconnected by a pivot brace member 14 that extends in a generally horizontal arrangement across what is considered a front of the walker. The side frames 10, 12 are mirror images of one another and in the preferred arrangement include a pair of downwardly extending legs 16, 18 that extend from a generally horizontal handle portion 20. The handle portion preferably includes a hand grip 22 that provides a non-slip, comfortable region for the user to grasp the walker. When in a use or deployed position (as shown), the legs 16 are located forwardly of legs 18 and each side frame assembly 10, 12 is disposed generally perpendicular to the pivot brace 14. The side frame assemblies are adapted for rotation relative to tubular portions 24, 26 that are integrally formed with the pivot brace. Of course, it will be recognized that the pivot brace and tubular members 24, 26 may be separate components that are fixed together to define the non-rotatable portion of the walker. The legs are held in spaced relation and supported by support members 30, and in the embodiment of FIG. 1 additional support members 32 are provided at the upper end of the legs 16, 18 of each side frame assembly. The support members provide additional rigidity to the structure. Moreover, the additional support members provide a convenient platform on which the single release assembly can be mounted (FIG. 1). In the preferred embodiment, the legs, pivot brace member, handle portions, and support members are all formed from lightweight tubular members, such as aluminum tubing, to provide a durable structure.

In the single actuator arrangement of FIG. 1, telescoping members 34, 36 are secured at their outer ends 38, 40 to the support members 32. A release or actuator pin 42 is centrally disposed on the actuator assembly and when depressed permits the telescoping members 34, 36 to slide relative to one another, thereby pivoting or rotating the side frame assemblies 10, 12 about the tubular portions 26 to a collapsed condition (not shown) adjacent to and generally parallel with the pivot brace member 14. Moreover, when deployed, the actuator member 42 locks the members 34, 36 from relative movement so that the legs remain in the operative position shown in FIG. 1.

Figure 2:
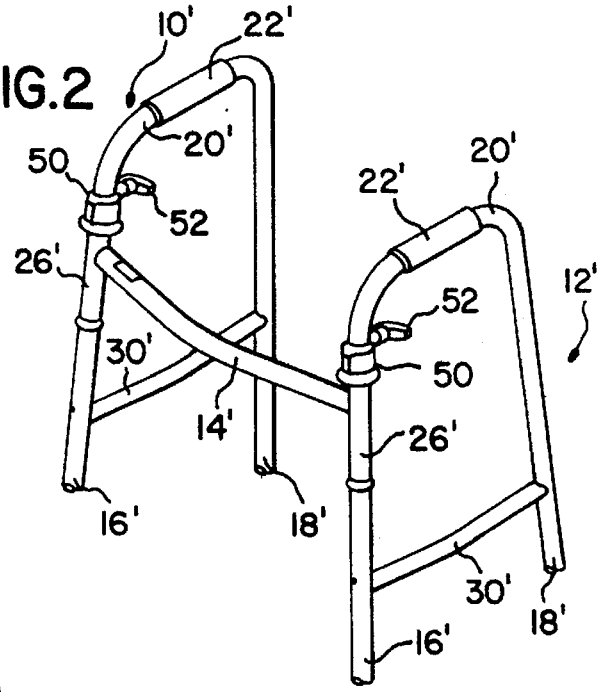
FIG. 2 is a perspective view similar to FIG. 1 and illustrating a dual release mechanism on a walker.

This single actuator arrangement is contrasted with FIG. 2 where there are no additional support members provided above the tubular members 26'. Instead, individual release or actuator mechanisms are provided on each leg, preferably at the upper end of the tubular members 26. The individual actuators 50 include a handle 52 that may be selectively moved from a first position to a second position, thereby allowing the side frame assemblies 10', 12' to rotate relative to the tubular members 26'. As described with respect to the FIG. 1 embodiment, this allows the side frame assemblies to be collapsed to a storage position generally abutting against the pivot brace member 14'. When the side frame assemblies are rotated outwardly as shown in FIG. 2, the actuators 50 serve to lock the side frame assemblies against rotation.

As is apparent, many of the features of the single and dual release walkers are substantially identical. However, the slight variation in structure between the two styles requires add-on features to be individually designed for each version, or modified for use with both. The present invention, though, provides a universal tray assembly that can fit both styles and still satisfy other desired features.

Figure 3:
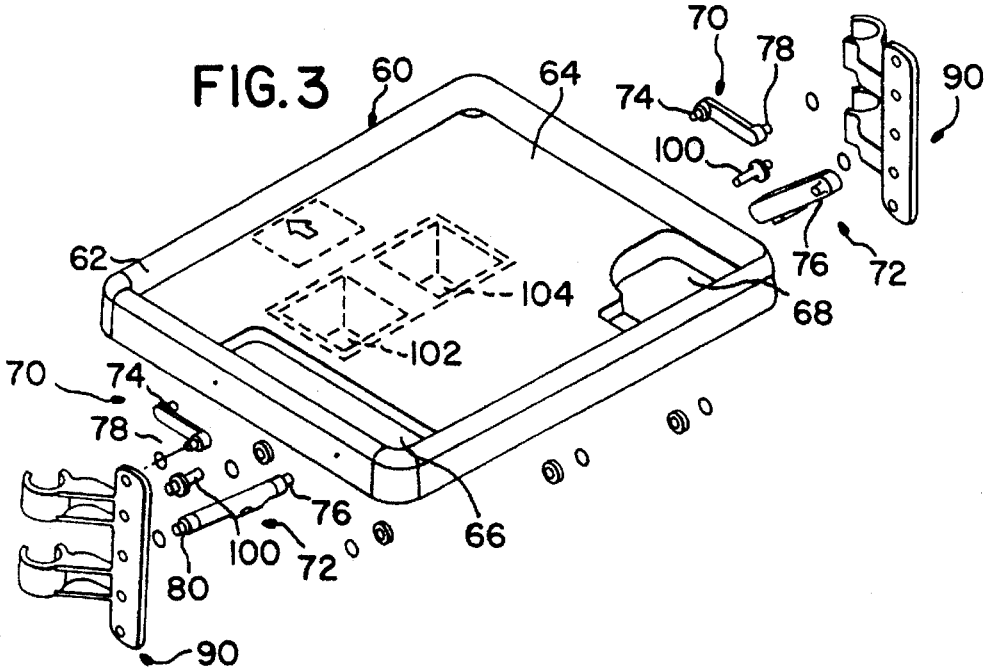
FIG. 3 is a perspective, exploded view of the subject new tray assembly.

Turning now to FIG. 3, a rectangular tray 60 has a peripheral, raised edge 62 that surrounds a generally planar portion 64. Depressed or recessed areas 66, 68 can also be formed in the surface 64 to facilitate retention of a cup, silverware, or the like. It will be recognized, however, that other shapes or tray configurations can be used without departing from the scope and intent of the subject invention.

Figure 4:
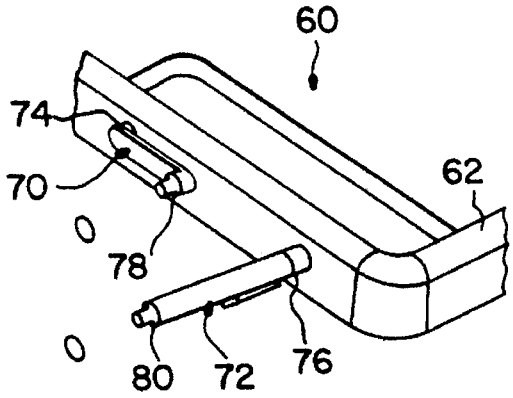
FIG. 4 is an enlarged perspective view of a pair of link arms used on one side of the tray.
Figure 5:
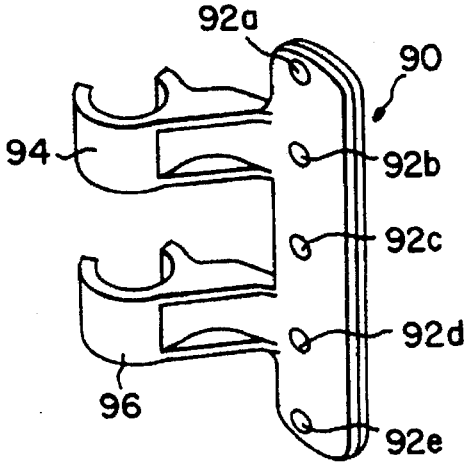
FIG. 5 is a perspective view of an individual mounting bracket.

First and second link members 70, 72 are provided on each side of the tray. More particularly, a first end 74 of the first link is secured to a sidewall of the tray (FIGS. 3 and 4), preferably through a snap fit connection. Likewise, a first end 76 of the second link member connects to the sidewall of the tray (FIG. 4). The connections allow the ends 74, 76 to rotate relative to the tray as will become more apparent below. Opposite ends 78, 80 of the first and second link members 70, 72, respectively, are secured to a respective support bracket 90, again, preferably being secured with connections that allow the link members to rotate relative to the support bracket.

Each support bracket is identical in construction so that description of one is applicable to the other. Structural details of the support bracket are best illustrated with reference to FIGS. 3–6 where a series of openings 92, five in number, are preferably provided on the bracket. The openings are generally equi-spaced along the bracket and, for purposes of convenience, are numbered 92*a*, 92*b*, 92*c*, 92*d*, and 92*e*. At least two of the openings are used to receive the second ends 78, 80 of the link members 70, 72, respectively, as will be described further below. Also, provided on the support brackets are a pair of integrally formed clamp arms 94, 96. A recess or opening in each clamp arm is generally C-shaped for snap-fit relation over the outer diameter of the tubing that forms the tubular members 26 and the frame members. The C-shaped configuration provides some resilience and flexibility in the structure so that it can be expanded upon application of manual force and snaps into tight gripping engagement with the outer surface of the frame assembly. Thus, the support bracket is not easily removed from the walker once mounted thereon.

When used, for example, with the single actuator walker of FIG. 1, one of the clamp arms, such as clamp arm 94, is preferably located above the additional support members 32. The other clamp arm, or second clamp arm 96, is received about the tubular member 26. As will become more apparent below, the orientation of the support bracket is reversed on the opposite side of the walker, i.e., the symmetrical configuration of the clamp arms permits the clamp arms to be rotated through 180° to achieve the positions shown in FIG. 3. The remainder of the support bracket extends forwardly from each side frame assembly so that the series of vertically spaced openings 92*a*–92*e* are positioned slightly inward from the side frame assemblies and project forwardly toward the pivot brace member 14.

Figure 6:
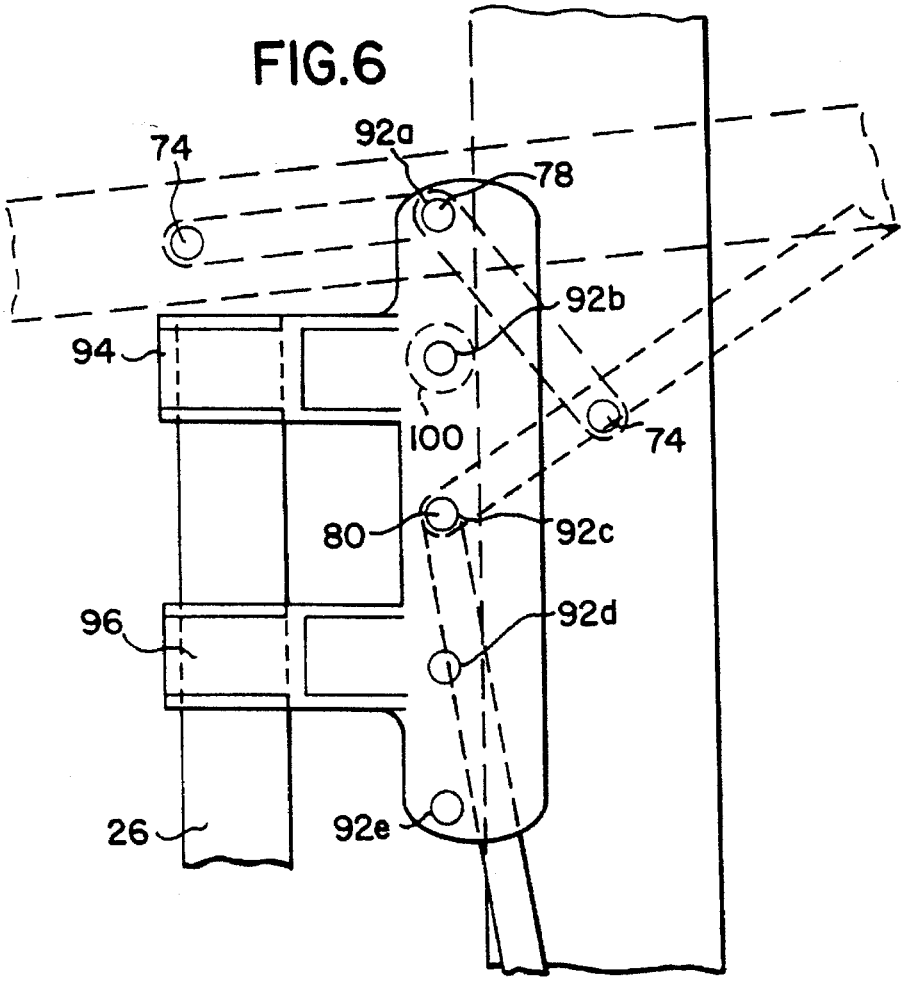
FIG. 6 is an elevational view of portions of the tray assembly shown in phantom in operative and storage positions.

The first and third openings 92*a*, 92*c* are adapted to receive the second ends 78, 80 of the first and second link arms, respectively. The second opening 92*b* receives a stop member 100 (FIG. 3) for reasons which will be described further below. As best illustrated in FIG. 6, the first link arm 70 is adapted for rotation through an angle exceeding 230°. That is, the second end 78 is fixed in opening 92*a* and the second end 74 rotates from a generally horizontal position (about 9 o'clock) where the tray is disposed in a generally horizontal operative position to a 5 o'clock position where the tray is located in a generally vertical or storage position. The longer, second link arm 72 rotates through an angle of approximately 90° wherein the second end 80 is fixed in opening 92*c* of the support bracket and the first end 76 rotates from an approximately 2 o'clock position to a 5:30 position.

In the storage position, the underside of the side wall of the tray abuts against the stop member 100 to limit further pivoting movement of the tray. Movement of the tray beyond the generally horizontal, operative position is limited by stop surfaces 102, 104 (FIG. 3) that are integrally molded on the underside of the tray. These stop surfaces are adapted for abutting engagement with the telescoping members 34, 36 on opposite sides of the actuating pin 42 in the FIG. 1 embodiment. In this manner, when the tray is disposed in an operative position, the underside of the tray will not inadvertently actuate or depress the pin. Thus, the side frame assemblies remain in the operative position.

When used with a dual actuator type of walker as shown in FIG. 2, the clamp arms 94, 96 are disposed above and below the pivot brace 14' about the tubular member 26'. Further pivoting movement of the tray past the vertical, storage position is prevented by abutting engagement between the underside of the tray and the pivot brace 14'. Likewise, pivoting movement past the generally horizontal position or operative position of the tray is limited by engagement of the underside of the tray with the pivot brace 14'. In this arrangement, however, the second end 78 of the first link member is located in the second opening 92*b* of the support bracket. Likewise, the second end 80 of the second link member is received in the fourth opening 92*d*. There is no requirement for a stop member, such as stop member 100, as used in the single actuator release arrangement of FIG. 1 because of the positive engagement between the underside of the tray and the pivot brace.

By providing a symmetrical support bracket arrangement, opening 92*a* is used on one side of the tray, while opening 92*e* is used on the other side of the tray for the FIG. 1 embodiment. Similarly, openings 92*b* and 92*d* are used on one side of the tray and the reverse arrangement of openings 92*d* and 92*b* are used on the other side of the tray. In this manner, the same support bracket can be used on the right-hand and left-hand side frame assemblies to thereby reduce inventory.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A walker having a tray selectively positioned between storage and operative positions comprising:

a walker frame having plural legs in spaced apart relation and handle portions at upper ends thereof adapted for gripping by a user;

a tray having opposed mid-portion edges and opposed front edges and further including a pivoting linkage assembly for securing the tray to the frame and selectively moving the tray between storage and operative positions, the pivoting linkage assembly including a pair of first link arms connected at first ends to the opposed mid-portion edges of the tray and at second ends to the frame, and a pair of second link arms connected at first ends to the opposed front edges of the tray and to the frame at second ends, the pivoting linkage assembly permitting movement of the tray from the operative position disposed in a generally horizontal plane to the storage position disposed in a generally vertical plane wherein the first link arms rotate about the second ends through approximately 180° from the storage position to the operative position of the tray.

2. The walker as defined in claim 1 further comprising a pair of brackets secured to the frame and to which the second ends of the first and second link arms are connected.

3. The walker as defined in claim 1 wherein the second link arms rotate through approximately 90° from the storage position to the operative position of the tray.

4. The walker as defined in claim 1 wherein the second ends of the link arms are secured to the frame in a generally vertical orientation.

5. The walker as defined in claim 4 wherein the second ends of the first link arms are connected to the frame above the second ends of the second link arms.

6. The walker as defined in claim 1 wherein the frame includes first and second front legs disposed in spaced relation and the tray is dimensioned for receipt between the first and second front legs in the storage position.

7. The walker as defined in claim 1 wherein the tray is dimensioned for receipt between the handle portions of the frame in the operative position of the tray.

8. A tray for a walker that includes spaced legs and handle portions for grasping by a user, the tray comprising:

a generally planar platform having a width dimension adapted for receipt between the handle portions of the walker when oriented in an operative horizontal position and adapted for receipt between the legs in a storage position;

a pair of first link arms disposed on opposite sides of the platform and adapted for pivotally mounting the platform to the legs, first ends of the first link arms connected to mid-portions of the platform and second ends of the first link arms adapted for connection to the legs wherein the pair of first link arms rotate through approximately 180° from the operative position to the storage position; and, a pair of second link arms having first ends connected to opposite sides of the platform and second ends adapted for connection to the legs.

9. The tray as defined in claim 8 wherein the pair of first link arms are shorter than the pair of second link arms.

10. The tray as defined in claim 8 wherein the pair of second link arms rotate through an angle of approximately 90° between the operative and storage positions of the platform.

* * * * *